US005678889A

United States Patent [19]

Purcell, Jr.

[11] Patent Number: 5,678,889

[45] Date of Patent: Oct. 21, 1997

[54] MOVEABLE THEATER SEATS

[76] Inventor: Joseph William Purcell, Jr., 13627 Morrison St., Sherman Oaks, Calif. 91423

[21] Appl. No.: 629,560

[22] Filed: Apr. 9, 1996

[51] Int. Cl.[6] ..... A47C 15/00

[52] U.S. Cl. ..... 297/257; 297/232; 297/344.16; 297/344.17; 297/344.2; 472/59; 472/60; 472/61; 434/45; 434/58

[58] Field of Search ..... 297/257, 232, 297/344.17, 344.16, 344.2, 325, 330; 248/419, 398, 188.1, 157; 472/59, 60, 61; 434/43, 45, 58

[56] References Cited

U.S. PATENT DOCUMENTS

| | | | |
|---|---|---|---|
| Re. 27,051 | 2/1971 | Cappel | 434/58 |
| 775,879 | 11/1904 | Wiersching et al. | 297/232 X |
| 2,300,004 | 10/1942 | Nicholson | 434/45 |
| 3,577,655 | 5/1971 | Pancoe | 434/58 |
| 3,628,829 | 12/1971 | Heilig | 472/59 X |
| 4,066,256 | 1/1978 | Trumbull | 472/60 |
| 4,251,140 | 2/1981 | Fogerty, Jr. | 472/60 X |
| 4,478,407 | 10/1984 | Manabe | 434/45 |
| 4,576,577 | 3/1986 | Lam et al. | 434/58 |
| 4,752,065 | 6/1988 | Trumbull et al. | 472/60 |
| 4,753,596 | 6/1988 | Hart et al. | 434/58 |
| 4,798,376 | 1/1989 | Trumbull et al. | 472/60 |
| 4,874,162 | 10/1989 | Trumbull et al. | 472/60 |
| 4,879,849 | 11/1989 | Hollingsworth et al. | 472/60 |
| 5,009,412 | 4/1991 | Roodenburg et al. | 472/59 |
| 5,022,708 | 6/1991 | Nordella et al. | 297/330 X |
| 5,071,352 | 12/1991 | Denne | 434/58 X |
| 5,433,670 | 7/1995 | Trumbull | 472/59 X |
| 5,496,220 | 3/1996 | Engstrand | 472/60 |
| 5,509,631 | 4/1996 | De Salvo | 472/59 X |
| 5,513,990 | 5/1996 | Gluck | 472/59 X |
| 5,533,933 | 7/1996 | Garnjost et al. | 472/60 |
| 5,545,040 | 8/1996 | Lu | 434/58 |

FOREIGN PATENT DOCUMENTS

| | | | |
|---|---|---|---|
| 136833 | 4/1985 | European Pat. Off. | 472/59 |
| 8909086 | 10/1989 | WIPO | 472/60 |

*Primary Examiner*—Peter M. Cuomo
*Assistant Examiner*—Rodney B. White
*Attorney, Agent, or Firm*—Saul Epstein

[57] ABSTRACT

A modular assembly of theater seats aligned in a row. Each of the seats in the row moves with an identical motion in response to a coordinated sequence to create seat motions which can complement a scene being protrayed on a movie screen. Three or more rotatable shafts run along the row under the seats. The shafts are caused to rotate by hydraulic cylinders coupled to the shafts through bell cranks. Each seat is supported by three legs which are also coupled to the shafts by bell cranks. Rotation of the shafts causes vertical motion of the legs, and by coordinating the motions of the individual legs, in the presently preferred embodiment of the invention, the seats can be made to move with linear vertical motion, or to rotate either side to side or fore and aft in the vertical plane. Linear fore and aft motion of the seats may be provided by a fourth rotatable shaft running along the row under the seats.

8 Claims, 2 Drawing Sheets

MOVEABLE THEATER SEATS

BACKGROUND OF THE INVENTION

This invention relates to hydraulically moveable theater seats. The seats of the present invention may be used in a theater to create a sensation of motion to complement a visual scene being portrayed on the screen, or in other applications where a sensation of motion is desired. The invention allows such seats to be made inexpensively and to require relatively little power to operate. In addition, the invented seats can be assembled in modules having a convenient number of seats, which modules can be lifted and carried; i.e., a portable system.

Prior attempts at devising such seats have resulted in relatively massive structures which require large amounts of power to move and/or are expensive.

SUMMARY OF THE INVENTION

In particular, the present invention involves modular units which include multiple seats in each module. The seats are arranged in a row, and the motions from a single set of hydraulic actuators are mechanically coupled to each of the seats in the module. The prior art includes systems using separate hydraulic actuators for each seat, or mounting a number of seats on a platform and driving the entire platform from one set of actuators. An important advantage of the invented arrangement over the prior systems is cost. Compared to either platform type systems, or seats with individual hydraulic actuators, the present invention provides significant economies. Hydraulic systems for driving massive systems are expensive, whereas small hydraulic systems and mechanical couplings for driving a limited number of seats are cheap. In the invented system there is no need for a massive moving platform which requires substantial power to move; only the seat itself moves, reducing the power requirements significantly. Also, each seat moves identically with respect to a fixed reference, as opposed to the differing motion of the seats in systems wherein multiple seats are mounted on a moving platform.

In the preferred embodiment of the invention, a plurality of seats are arranged in a row, each seat being supported by three moveable legs—the first in the center of the front of the seat, and the second and third at each side of the rear of the seat. The lower end of each of the three legs is coupled to a bell crank carried by a horizontal shaft extending along the row under the seats. A fourth member coupled to the seats is a telescoping member which is used to impart front to back linear motion to the seats, and also to provide lateral stability. The telescoping members are also coupled to a horizontal shaft running parallel to the row under the seats. There are thus four shafts extending along the row of seats, each shaft being coupled through a bell crank to one of the support points on each seat. The shafts are individually rotated by hydraulic cylinders, which rotations cause the seats to move in synchronism. Appropriate hydraulic controls can cause the seats to move so as to create whatever effect is desired.

For descriptive purposes, the motions of the seats can be described by motions relative to three orthogonal axes, x, y, and z. The x axis is a horizontal axis along the row, the y axis is a horizontal axis perpendicular to the direction of the row, and the z axis is the vertical axis. Any desired motion of the seats can be created by translating and/or rotating the seats with respect to the x, y, and z axes. Of the six possible motions (translation and rotation with respect to the three axes) the presently preferred embodiment of the invention utilizes four. By driving the hydraulic cylinders appropriately, the motion can be made pure z axis motion (up/down), pure y axis motion (front/back), rotation around the the x axis (front/back rotation), rotation around the y axis (side to side rotation), or any combination thereof.

The two other possible motions, namely rotation around the z axis and/or linear motion along the x axis could be added if desired. These motions, however, are not believed important for most entertainment applications, and a four axis system is satisfactory for most applications. An even simpler system can be used in many applications. In many cases, motions about only three axes need be provided to achieve a satisfactory sensation. These three axes are i) z axis linear motion, ii) rotation about the x axis, and iii) rotation about the y axis. These three motions are provided by the three shafts coupled to the three legs supporting the seats.

DETAILED DESCRIPTION OF THE INVENTION

Figure 1:
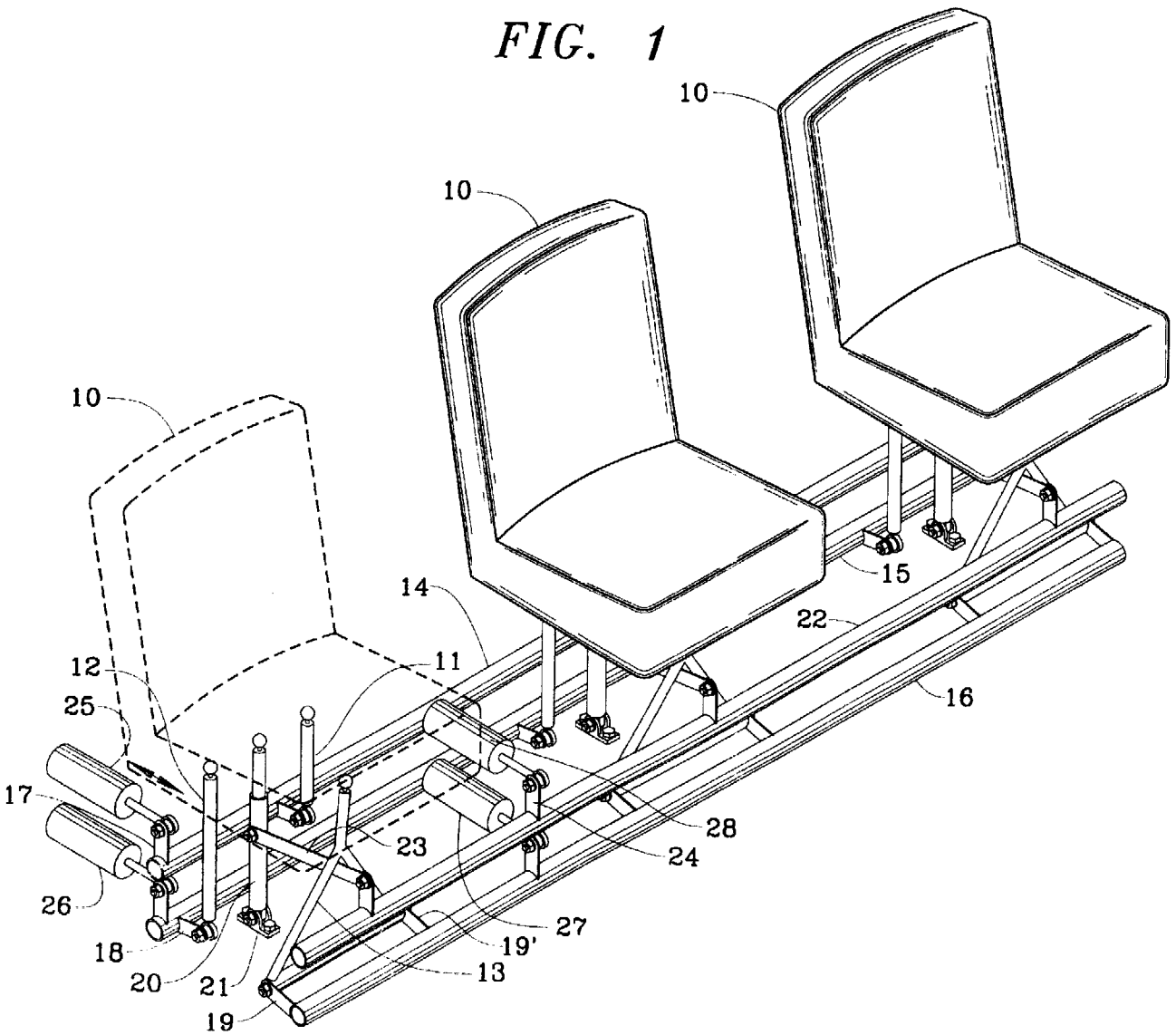
FIG. 1 is a perspective view of a row of theater seats embodying the present invention.
Figure 2:
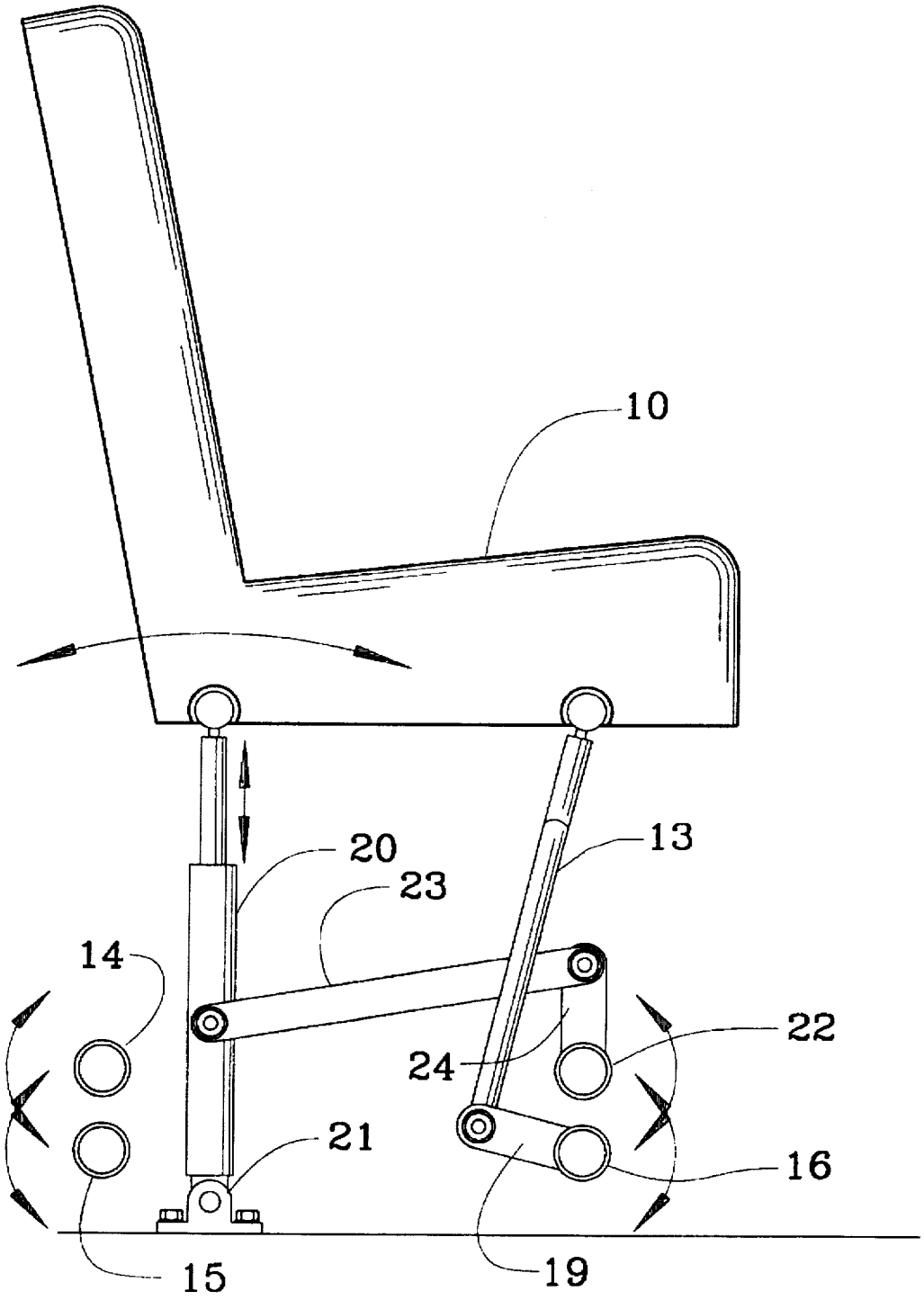
FIG. 2 is a side cross sectional view of one of the theater seats shown in FIG. 1 taken at 2—2 of FIG. 1.

FIG. 1 shows shows a row of theater seats embodying the present invention. The number of seats in the row can be any desired number, but for illustrative purposes FIG. 1 shows three seats 10 in the row. Each seat is supported by three legs 11, 12, and 13 which attach to the seats through ball joints (not numbered). The front leg 13 is preferably made in the form of an inverted "Y", the top end of which attaches to the center of the front portion of the seat. The function of the inverted "Y" configuration of leg 13 will be explained below. Legs 11 and 12 may be rods or tubes, and attach to the rear of the seat at each side. The bottom ends of the legs are coupled to three rotatable shafts 14, 15, and 16 through hell cranks 17, 18, 19, and 19' The connections between the legs and the bell cranks are also made through ball joints. The legs 11, 12, and 13 provide the motions necessary for z axis displacement and also for rotation about the x and y axes. While as shown, legs 11 and 12 are coupled near the rear of the seat, and leg 13 is coupled near the front of the seat, it will be appreciated that other connection patterns could be used, so long as the coupling points of the three legs to the seat are not in a line.

Since legs 11, 12, and 13 are coupled to the seats and to their associated bell cranks through ball joints, some means must be provided for lateral stability, else the seats will not remain in position. In particular, the seats must be prevented from unrestrained linear motion in the directions of the x and y axes, as well as from rotation about the z axis. The presently preferred means for providing the needed lateral stability is discussed below.

Lateral stability means to prevent unwanted motions along the x and y axes, as well as to provide intentional y axis linear motion is provided in the illustrated embodiment by a telescoping member 20 which is coupled to the rear of the seat by a ball joint and to the floor through a bearing 21. The bearing 21 permits fore and aft rotation of the telescoping member, but no side to side motion. The telescoping member 20 is coupled to a fourth rotatable shaft 22 through linkage rod 23 and bell crank 24. Greater lateral strength may be provided by making the lower portion of telescoping member 20 in the form of an inverted "Y", and fastening it to the floor through two spaced bearings 21. The seats are prevented from z axis rotation about telescoping member 20 as a center by the action of the inverted "Y" configuration of leg 13.

The four rotatable shafts 14, 15, 16, and 21 are supported by bearings, not shown, and are driven by hydraulic cylinders 25, 26, 27, and 28 through bell cranks. By controlling the motions of the four hydraulic cylinders 25, 26, 27, and 28, the seats can be made to move with pure z axis motion (up and down motion), pure y axis motion (fore and aft motion), rotation about the x axis (fore and aft rotation), and/or rotation about the y axis (side to side rotation in the vertical plane). By properly coordinating the sequence of motions of the hydraulic cylinders, any desired combination of the above motions can be attained so as to create the sensation of motion to accompany a scene being displayed on a theater screen, or otherwise for enjoyment. Control systems for imparting the desired motions to the hydraulic cylinders used in connection with the present invention are well known in the art, and are not described here.

For those applications which require only three motions, i.e., where y axis linear displacement is not deemed necessary to create the desired effect, the lower end of telescoping member 20 is firmly fixed to the floor so that the upper end is vertical. Linear motion of the seat is thus restricted to z axis motion, linear x axis and y axis motions being prevented by the telescoping member 20. Bearing 21 and linkage rod 23 with its associated rotatable shaft and hydraulic cylinder are omitted. In this configuration, the seats may move linearly in the z axis direction, and may rotate about the x and y axes in accordance with the motions imparted to the shafts 14, 15, and 16 by hydraulic cylinders 25, 26, and 27.

I claim:

1. A row of moveable theater seats which comprises:

a plurality of seats arranged in a row, each of said seats having a front and a rear;

first, second, and third legs coupled to each of said seats at spaced points;

first, second, and third coupling means for mechanically coupling each of said first, second, and third legs, respectively, together;

means coupled to each of said coupling means for imparting vertical displacements to said legs in accordance with a coordinated sequence; and lateral support means associated with each of said seats for providing lateral stability to said seats.

2. A row of moveable theater seats as recited in claim 1 where said coupling means comprises:

three rotatable shafts extending under said seats along said row, each of said shafts being coupled to one of said legs on each of said seats in such manner as to cause said leg to move vertically as said shaft is rotated; and said means for imparting vertical displacements to said legs includes;

a hydraulic cylinder associated with each of said shafts, each of said hydraulic cylinders being coupled to its associated shaft to cause said shaft to rotate.

3. A row of moveable theater seats as recited in claim 2 where said first and second legs are coupled to said seats at spaced points adjacent to the rear of each of said seats and said third legs are coupled to said seats adjacent to the front of said seats.

4. A row of moveable theater seats as recited in claim 1 where said first and second legs are coupled to said seats at spaced points adjacent to the rear of each of said seats and said third legs are coupled to said seats adjacent to the front of said seats.

5. A row of moveable theater seats as recited in claim 1 where said lateral support means includes a fixed telescoping member.

6. A row of moveable theater seats as recited in claim 5 where said coupling means comprises:

three rotatable shafts extending under said seats along said row, each of said shafts being coupled to one of said legs on each of said seats in such manner as to cause said leg to move vertically as said shaft is rotated; and said means for imparting vertical displacements to said legs includes:

a hydraulic cylinder associated with each of said shafts, each of said hydraulic cylinders being coupled to its associated shaft to cause said shaft to rotate.

7. A row of moveable theater seats as recited in claim 1 where said lateral support means includes a telescoping member rotatable about an axis parallel to said row, and further including means for rotating said telescoping member about said axis parallel to said row in accordance with said coordinated sequence.

8. A row of moveable theater seats as recited in claim 7 where said coupling means comprises:

three rotatable shafts extending under said seats along said row, each of said shafts being coupled to one of said legs on each of said seats in such manner as to cause said leg to move vertically as said shaft is rotated; and a fourth rotatable shaft extending under said seats along said row, said shaft being coupled to said telescoping member on each of said seats in such manner as to cause said telescoping member to rotate as said shaft is rotated; and said means for imparting vertical displacements to said legs includes:

a hydraulic cylinder associated with each of said shafts, each of said hydraulic cylinders being coupled to its associated shaft to cause said shaft to rotate.

* * * * *